US005573241A

United States Patent [19]

Anderson

[11] Patent Number: 5,573,241

[45] Date of Patent: Nov. 12, 1996

[54] PROTECTOR FOR A GOLF CLUB SHAFT

[76] Inventor: Doc A. Anderson, 1972 Rue Chateau, Chula Vista, Calif. 91913

[21] Appl. No.: 323,269

[22] Filed: Oct. 14, 1994

[51] Int. Cl.[6] ..... A63B 53/00

[52] U.S. Cl. ..... 473/282; 150/160; 206/315.2

[58] Field of Search ..... 150/154, 160, 150/162; 206/315.4, 315.3, 315.2; 273/32 E; 138/110, 138, 154; 473/282

[56] References Cited

U.S. PATENT DOCUMENTS

| | | | |
|---|---|---|---|
| 2,201,779 | 5/1940 | Lathrop | 220/903 X |
| 3,965,955 | 6/1976 | Price | 150/160 |
| 4,662,415 | 5/1987 | Proutt | 150/160 |
| 4,667,716 | 5/1987 | Solheim et al. | 206/315.4 X |
| 4,778,700 | 10/1988 | Pereira | 138/151 X |
| 4,938,349 | 7/1990 | Burns | 206/315.6 |
| 5,005,624 | 4/1991 | Sung | 150/160 |
| 5,050,884 | 9/1991 | Flory | 150/160 X |
| 5,088,600 | 2/1992 | Kopp | 206/315.2 |
| 5,133,395 | 7/1992 | Moore | 206/315.2 X |
| 5,215,136 | 6/1993 | Flanders et al. | 150/160 |
| 5,275,278 | 1/1994 | Henry | 206/315.6 |
| 5,284,194 | 2/1994 | Gaffney | 150/160 |
| 5,421,371 | 6/1995 | Lauer | 138/110 |
| 5,465,759 | 11/1995 | Carlson et al. | 138/110 |

FOREIGN PATENT DOCUMENTS

| | | | |
|---|---|---|---|
| 2267833 | 12/1993 | United Kingdom | A63B 57/00 |

*Primary Examiner*—Allan N. Shoap
*Assistant Examiner*—Christopher J. McDonald
*Attorney, Agent, or Firm*—Laurie A. Axford

[57] ABSTRACT

The present invention relates to an accessory for golf clubs, and more particularly to a device for protecting golf club shafts composed of materials such as graphite. It is designed primarily to protect the section of the golf club shaft which is nearest to the head of a golf club, which is especially prone to marring and abrasion during transport, storage and use. Primarily, it consists of an outer surface and an inner surface which, combined, form a protective component, with a fastening component attached thereto for securing the golf club shaft protector in place.

5 Claims, 1 Drawing Sheet

PROTECTOR FOR A GOLF CLUB SHAFT

FIELD OF THE INVENTION

The present invention relates to an accessory for golf clubs, and more particularly to a device for protecting the shaft of non-metallic golf clubs from excess wear.

BACKGROUND OF THE INVENTION

As many as 14 golf clubs (the maximum number of golf clubs allowed for play) art typically stored and carried in the same golf bag. They are generally inserted into a golf bag "upside down", i.e. with the handles inserted first to allow for the golf club heads to stick out of the top of the bag. Storage and transport of several clubs in the same bag results in the clubs being jostled against each other and excess wear to the shaft caused by repeated contact with the dividers or separators which are typically placed in the top of a golf bag.

An additional source of abrasion to the shaft is caused by the use of rigid plastic tubes which are used to individually house golf club shafts in a golf bag. Various improved tubes have been described, such as the protective tube described in U.S. Pat. No. 4,938,349 (P. H. Burns, "Protective Tube for a Golf Cub Shaft", issued 3 Jul. 1990) which has a protective collar and optional protective lining to prevent abrasion to golf club shafts. U.S. Pat. No. 5,088,600 (F. H. Kopp, "Golf Club Shaft Protector Tube", issued 18 Feb. 1992) describes a protective tube which is lined with a soft material. U.S. Pat. No. 5,275,278 (C. J. Henry et al., "Golf Club Shaft Protector", issued 4 Jan. 1994) describes a protective tube with a throat element to hold the golf club shaft in place within the tube. Although these tubes help protect golf club shafts, they are expensive, they can add excessive weight to a golf bag and they limit the number of golf clubs which can be carried in a single bag.

The use of head covers for protection of the golf club heads is well known. They are typically made of flexible materials, such as fabric or leather, and help protect the golf club heads form striking one another. Many golf club head covers also extend into the shaft portion of the golf club for additional protection. U.S. Pat. No. 5,005,624 (H. H. Sung, "Device for Protecting Golf Clubs", issued 9 Apr. 1991) describes a combination head cover/shaft protector which encases the entire golf club, including the handle. U.S. Pat. No. 5,284,194 (J. H. Gaffney, "Golf Club Head and Shaft Cover", issued 8 Feb. 1994) describes a head cover which extends over a portion of the shaft. These combination head and shaft covers are primarily designed to protect the head and only secondarily protect the shaft, since they are form-fitted for the head portion and only loosely cover the shaft. As such, they generally do not adequately protect the shaft.

Recent advances in golf club technology include the use of new shaft materials. In particular, the use of non-metallic shafts is now widespread. These materials are improvements over their metallic counterparts because of their lighter weight and improved resiliency. One of the best known materials presently used for golf club shafts is graphite. However, graphite is very susceptible to abrasion and marring from normal everyday usage, storage and carriage in golf bags. This can affect the structural integrity of a golf club as well as causing an unpleasing appearance.

Protective devices for golf club shafts have been described. U.S. Pat. No. 5,050,884 (R. Flory, "Golf Club Combined with Shaft Protector", issued 24 Sep. 1991) describes a foam tube which extends the entire length of the shaft and has a side slit for inserting the shaft. Patent Application GB 2,267,833A (R. A. Gladden, "Protective Device", published 22 Dec. 1993) describes a similar shaft protector which is also formed from a foam-like material and has a side slit. These devices do not securely fasten around the golf club shaft and, after a certain amount of wear from insertion and removal of the shaft, they can become loose-fitting and do not adequately protect the shaft.

Accordingly, the present invention affords a golf club shaft protector which fits closely around a golf club shaft and can be secured in place. It can be used in conjunction with traditional golf club head covers and does not add appreciable additional space or weight to a golf bag and club assembly. It prevents scratching and marring due to the abrasive effects of most golf bags as well as repeated contact with the heads of golf clubs which are carried, transported or stored together.

BRIEF DESCRIPTION OF THE DRAWINGS

The present invention can be more fully understood by reference to the following detailed description of the preferred embodiment of the present invention when read in conjunction with the accompanying drawings wherein.

MODES FOR CARRYING OUT THE INVENTION

The following detailed description illustrates the present invention by way of example and not by way of limitation. The description herein will enable one skilled in the art to make modifications, adaptations and variations of the present invention without departing from the spirit and scope of the claims.

Figure 1:
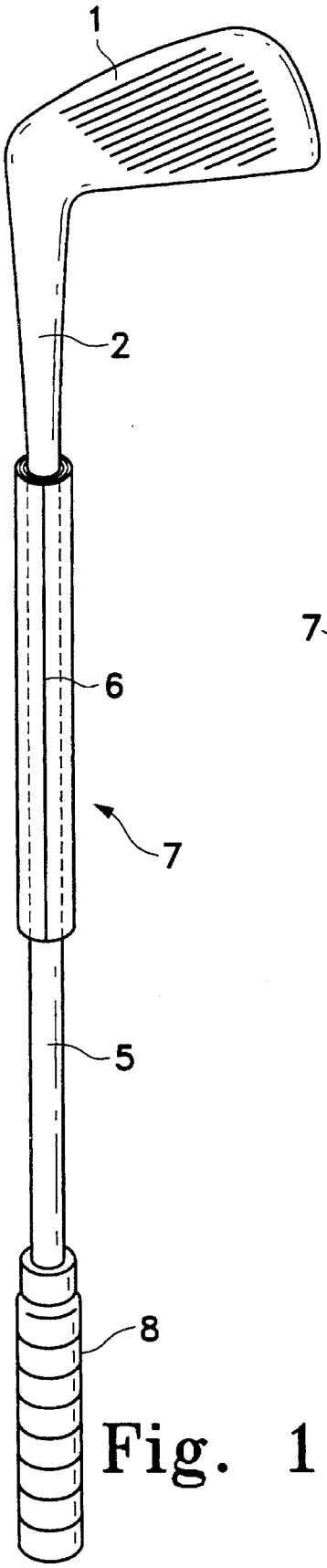
FIG. 1 is a perspective view of a golf club shaft protector according to the present invention.

Referring now to FIG. 1, a golf club shaft protector according to the present invention is illustrated generally as 7. The protector 7 wraps snugly around the golf club shaft 5 in close proximity to the hosel 2 and extends downward towards the handle 8. The protector 7 preferably extends less than half the length of the golf club shaft 5 and more preferably extends 6 to 18 inches down the length of the golf club shaft 5 from the hosel 2.

The outside diameter of the protector 7 when in use is preferably less than twice the diameter of the golf club shaft 5, thus allowing for use in conjunction with most standard covers which fit over the golf club head 1. It is also preferably less than the widest diameter of the handle 8, for ease of insertion of the golf club into a golf bag while the protector 7 is in place. In some cases, when the protector 7 is simultaneously used with a golf club head cover, the head cover will extend down over the protector 7.

The golf club shaft 5 increases in diameter as it extends from the end closest to the golf club head 1 towards the handle 8. This taper aids in the secure placement of the protector 7 and prevents it from slipping downward towards the handle 8. The golf club shaft 5 is typically composed of non-metallic substances such as graphite and as such is protected from marring and abrasion by the protector 7.

Figure 2:
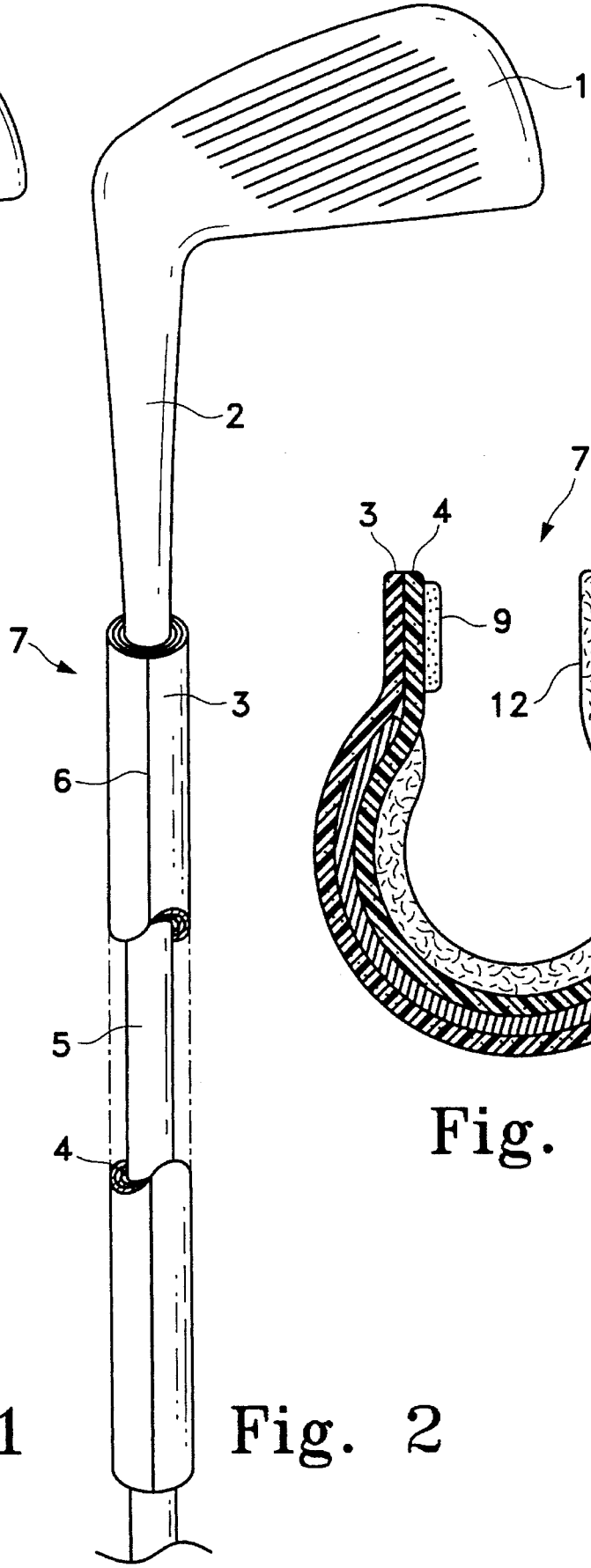
FIG. 2 is an exploded perspective view of the components which comprise the golf club shaft protector according to the present invention.

FIG. 2 shows a perspective view of the protector 7. The protector 7 comprises a protective component and a fastening component. The protective component comprises an outer surface 3 and an inner surface 4. The outer surface 3 and the inner surface 4 are joined together by stiching, adhesives or the like. It is also possible that the outer surface 3 and the inner surface 4 are made from one continuous piece of material which is folded in half and then sewn or adhered together. When the protector 7 is secured in place, the outer surface 3 and the inner surface 4 can meet without overlapping at junction 6 as depicted in FIG. 1 and FIG. 2. Preferably, the outer surface 3 and the inner surface 4 will overlap when secured in place.

Figure 3:
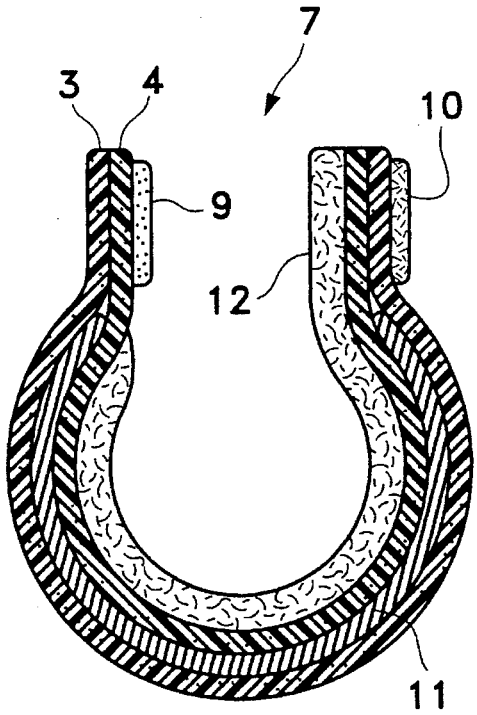
FIG. 3 is a sectional view of a preferred embodiment of the golf club shaft protective device according to the present invention.

The outer surface 3 is typically formed from a durable deformable material such as fabric, foam or leather. The inner surface 4 may be formed from the same or different material as the outer surface 3, and is optionally covered with a lining 12 as depicted in FIG. 3 which is composed of a soft material such as velour, felt, fur or cotton knit. In particular, if the outer surface 3 and inner surface 4 of the protector 7 are both composed of a heavier weight material such as leather, it is preferred to have an optional lining 12.

In a preferred embodiment, the protector 7 contains therein an optional rigid element 11 as depicted in FIG. 3 which is composed of a material such as metal, wire or plastic which is capable of resilient deformation upon insertion of the golf club shaft 5 into the protector 7. The rigid element 11 generally extends the entire length of the protector 7 and has a cylindrical or "C" shape with an inner diameter which approximates the smallest outer diameter of the golf club shaft 5 when the protector 7 is in use.

The protector 7 has at least one fastening component for securing the protector 7 in place during usage. Examples of fastening components which are easily fastened and unfastened and therefor useful in the present invention include but are not limited to snaps, laces, hook-and-eye, zippers and fastening tapes. The fastening component or components may be positioned intermittently throughout the length of the protector 7, such as every one or two inches, or the fastening component may run the entire length of the protector 7, such as with zippers or fastening tapes. The fastening component is not visible in FIG. 1 and FIG. 2.

In FIG. 3, there is depicted a cross-sectional view of a preferred embodiment of the protector 7 before being secured in place around a golf club shaft, i.e. in the unfastened position. Fastening tapes 9 and 10 are depicted and consist of a multiplicity of small plastic hooks on a first tape which are designed to mate with a multiplicity of small lops on an oppositely located second tape. Such fastening tape is commercially available under the trademark Velcro. Together, fastening tapes 9 and 10 make up the fastening component while the outer surface 3, the inner surface 4, the rigid element 11 and the lining 12 comprise the protective component.

I claim:

1. A golf club and golf club shaft protector assembly comprising, a golf club having a shaft and a golf club shaft protector, said protector comprising:

a protective component comprising an outer surface, an inner surface and a rigid element, wherein said rigid element is disposed between and is more rigid than said outer surface and said inner surface; and a fastening component, said fastening component being attached to said protective component, such that when said fastening component is in the fastened position, said protective component closely surrounds said golf club shaft;

wherein the length of said protector extends less than the full length of the golf club shaft.

2. The assembly of claim 1 wherein the inner surface has attached thereto a lining.

3. The assembly of claim 1 wherein the length of said protector is between 6 and 18 inches.

4. The assembly of claim 1 wherein said fastening component extends the entire length of said protector.

5. The assembly of claim 1 wherein the outside diameter of said protector when in use is less than twice the diameter of said golf club shaft.

* * * * *